United States Patent [19]

Petvai

[11] 4,278,493

[45] Jul. 14, 1981

[54] METHOD FOR CLEANING SURFACES BY ION MILLING

[75] Inventor: Steve I. Petvai, Wappingers Falls, N.Y.

[73] Assignee: International Business Machines Corporation, Armonk, N.Y.

[21] Appl. No.: 144,461

[22] Filed: Apr. 28, 1980

[51] Int. Cl.[3] ..... B08B 3/12; B08B 6/00; B08B 7/00; B44C 1/22

[52] U.S. Cl. ..... 156/643; 134/1; 134/33; 156/639; 156/640; 156/646; 204/192E; 204/298

[58] Field of Search ..... 134/1, 33; 204/32, 141.5, 204/192 E, 298; 156/643, 646, 639, 640, 345; 250/423 R, 424, 427

[56] References Cited

U.S. PATENT DOCUMENTS

| | | | |
|---|---|---|---|
| 3,528,387 | 9/1970 | Hamilton | 118/723 |
| 3,548,189 | 12/1970 | Meinel et al. | 156/643 X |
| 3,769,109 | 10/1973 | MacRae | 156/655 X |
| 3,868,271 | 2/1975 | Poley et al. | 134/1 |
| 4,016,062 | 4/1977 | Mehta | 204/192 E |
| 4,098,917 | 7/1978 | Bullock et al. | 427/36 |
| 4,126,530 | 11/1978 | Thornton | 204/192 EC |
| 4,135,998 | 1/1979 | Gniewek et al. | 204/192 E |
| 4,147,573 | 4/1979 | Morimoto | 156/643 X |
| 4,148,705 | 4/1979 | Battey et al. | 204/192 E |

OTHER PUBLICATIONS

J. Vac. Sci. Technol., vol. 13, No. 5, Sep./Oct. 1976, Ion Etching for Pattern Delineation by C. M. Melliar-Smith, pp. 1008-1021.

J. Vac. Sci. Technol., vol. 15, No. 5, Sep./Oct. 1978, Influence of Sample Inclination and Rotation During Ion-Beam Etching on Ion-Etched Structures by Sumio Hosaka et al., pp. 1712-1717.

*Primary Examiner*—William A. Powell

*Attorney, Agent, or Firm*—Theodore E. Galanthay

[57] ABSTRACT

A method for cleaning uneven substrate surfaces having channels, via holes or stepped surface topography. In accordance with the method, an electron beam device which generates a solid angle source of ions is provided. A substrate having an uneven surface topography is oriented in the path of the solid angle source of ion at a particular angle with reference to the center line of the ion beam source. While in the particular orientation with respect to the center line, the substrate is rotated about an axis normal to the plane of the substrate surface.

5 Claims, 3 Drawing Figures

METHOD FOR CLEANING SURFACES BY ION MILLING

DESCRIPTION

BACKGROUND OF THE INVENTION

1. Field of the Invention

The present invention relates to a method for cleaning semiconductor surfaces having uneven surface topography and more particularly relates to a method for ion-beam etching of semiconductor surfaces having uneven surface topography so as to clean the surfaces and provide a suitable surface for subsequent operations on the semiconductor surface.

2. Description of the Prior Art

Ion etching, which includes the processes of ion beam milling and RF sputter etching, is the process by which a substrate surface is slowly eroded by bombardment with a stream of high-energy ions. The erosion process is one of momentum transfer between the impinging ions and the atoms of the substrate, by which the substrate atoms receive sufficient momentum to be carried away from the substrate. This type of sputter erosion is well known for the purpose of etching or ion milling the surface of a substrate. For example, U.S. Pat. No. 3,528,387 to Hamilton describes a method for ion cleaning of a substrate and subsequent vapor deposition. The ions are emitted into a vacuum chamber through a small port generally aligned toward the substrate. The ions are used to bombard the substrate to clean its surface prior to deposition of a material, such as a metal film, onto the substrate. It is also disclosed that the ions may bombard the substrate during or after the deposition step to improve adherence of the deposited metal film on the substrate.

While ion etching, particularly ion beam milling, has been found to be very useful in cleaning the surface of a substantially planar substrate surface prior to effecting blanket deposition of a coating, such as a metal or insulator coating, there have been problems associated with ion etching when used to clean a substrate surface having topological irregularities in the surface. This problem is usually associated with the fact that the ions leaving the surface of the substrate tend to interact with ions impinging on the surface. This causes redeposition of the ions removed by the ion etching step and interferes with the milling operation. Various designs of catcher assemblies have been proposed to "catch" the substrate ions leaving the surface and prevent their redeposition. One type of catcher assembly is disclosed in an article of C. M. Melliar-Smith, "J. Vac. Sci. Technol., Vol. 13, No. 5, Sept./Oct. 1976, pp. 1008–1021. While catcher assemblies have been helpful in alleviating the problem of redeposition, they have not been wholly successful and it is desirable to provide a method for ion etching whereby the surface of substrates having topological irregularities can be cleaned effectively prior to performing other operations on the substrate surface.

It has been found that a substrate having an irregular surface, such as a channeled or stepped surface, can be effectively cleaned by ion milling if the substrate surface is oriented in a particular manner while it is exposed within the solid angle of an ion beam. The method is particularly adapted for cleaning via channels which are used for interconnecting layers of metal separated by an insulating layer.

SUMMARY OF THE INVENTION

It is a primary object of the present invention to provide a method for cleaning a substrate surface by ion milling.

It is another object of the invention to provide a method for cleaning the surface of a substrate having an uneven topography by ion milling without substantial redeposition of ions removed by the ion milling cleaning step.

In the method of the present invention for cleaning uneven substrate surfaces having channels, via holes or stepped surface topography, in accordance with the foregoing objects, an electron beam device which generates a solid angle source of ions is provided. The substrate having an uneven surface topography is oriented in the path of the solid angle source of ions at a particular angle with reference to the center line of the ion beam source. While in the particular orientation with respect to the center line, the substrate is rotated about an axis normal to the plane of the substrate surface. In a preferred embodiment of the invention, the particular angle with reference to the center line is attained while moving the substrate surface across the pathway of the solid angle of ions.

Other objects of the invention will become more apparent from the following detailed description with reference to the accompanying drawings.

DESCRIPTION OF THE ILLUSTRATED EMBODIMENT

Figure 1:
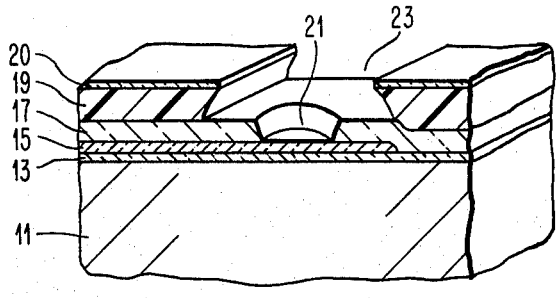
FIG. 1 is perspective cross-sectional view, partially broken away, of a semiconductor substrate having a channel and a via hole which is typical of substrate surfaces having uneven surface topography which is desired to be cleaned.

A typical semiconductor substrate 11 having an uneven surface topography is shown in FIG. 1. An insulating layer 13 is located on the surface of the substrate 11. A metal layer 15 is deposited upon the insulating layer 13 and an insulating layer 17 is deposited over the surface of metal layer 15. A photoresist layer 19 is used to develop patterns in accordance with usual procedures. As shown in FIG. 1, a via hole and interface 21 has been formed in the insulating layer 15 and a channel 23 for deposition of a second layer of metallization (not shown) has been exposed in the photoresist layer 19. A silicon glass layer 20 is deposited on the surface of the photoresist layer to protect it during ion beam etching.

As indicated, it is desirable to clean the surface of the insulating layer 17 and the surface of the metal layer 15 at the bottom of via hole 21 by ion milling prior to deposition of the second layer of metallization into channel 23 and via hole 21. Direct frontal ion milling of the substrate 11, however, results in an uneven removal of ions from the insulating layer 17 and the metal layer 15 through redeposition of removed ions with impinging ions from the ion beam.

Figure 3:
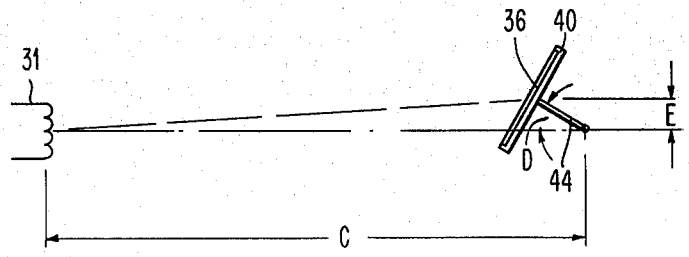
FIG. 3 is a schematic cross-sectional view of ion beam apparatus useful in performing the method of the present invention.

A typical ion beam apparatus utilizing the concepts of the present invention is shown in schematic form in FIG. 3. A vacuum chamber 25 is provided with a vacuum source 27 and an inert gas source 29. The inert gas is usually argon. A heated filament 31 heats the inert gas in the vacuum chamber 25 to provide a plasma source located generally in the area 32 and acts as the cathode. An anode grid 34 is located downstream from the cathode filament 31. Extraction grids 35 extract the ions from the plasma source and accelerate them towards a substrate 36 located at the opposite end from the heating filament 31. A magnetic field is usually provided in the plasma source area 32 by means of a coil 38 or a permanent magnet. The magnetic field provides a helical electron path to increase the source ionization.

In accordance with the invention, a semiconductor wafer 36 having an uneven surface topography similar to that of substrate 11 in FIG. 1, is held in a substrate holder 40 which is connected to motor means 42 by means of shaft 44. In one preferred embodiment, motor means 42 comprises two separate electric powered motors for moving the substrate holder 40 simultaneously in two separate directions, as described more fully hereinafter. A catcher anode 46 is provided to capture ions milled from the surface of the substrate and prevent redeposition of the ions. As will be explained more fully hereinafter, the method of the present invention for ion milling the surface of a substrate provides milling of the surface at an optimum position to release the ions for capture by the catcher anode 46.

Figure 2:
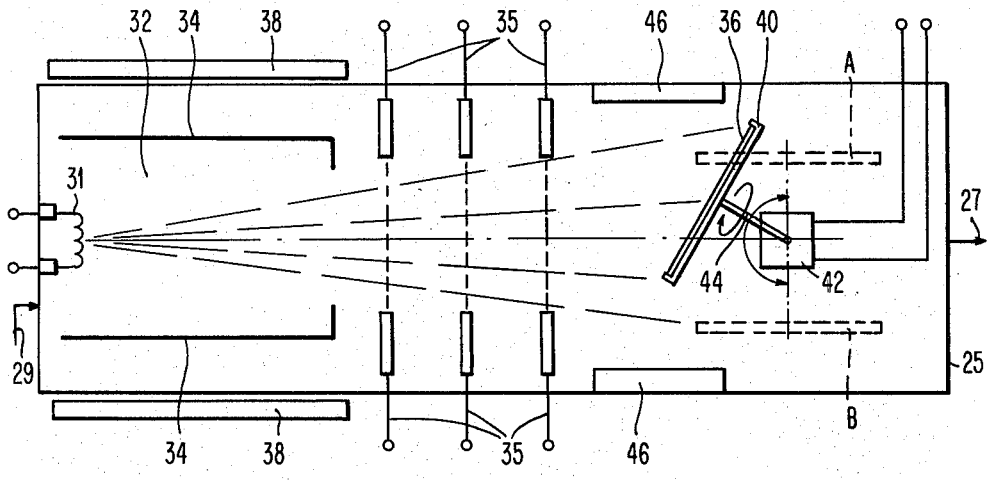
FIG. 2 is a schematic outline showing various angular and spatial relationships of the ion beam apparatus used in cleaning substrate surfaces having an uneven surface topography.

In practice, a wafer 36 is inserted into vacuum chamber 25 into substrate holder 40 at a first position shown in phantom outline and marked A in FIG. 2. The vacuum source 27 is activated and the pressure in vacuum chamber 25 is reduced to a suitable pressure for ion milling. Suitable pressures are in the range of $1\times10^{-7}$ to about $4\times10^{-4}$ Torr. Argon is emitted into vacuum chamber 25 through the inert gas source 29 to back fill the plasma source area 32 with argon atoms. The heated filament thermionically boils off electrons which are accelerated by the plasma power supply to the anode 34. During transition from the cathode to the anode they interact with the argon atoms in the plasma source area producing argon ions by electron stripping. The gas pressure at the plasma source area 32 is generally in the $10^{-4}$ Torr range to sustain a plasma.

After a solid angle ion beam is generated by the extraction grids 35, the substrate holder 40 is activated by motor means 42 so as to rotate the substrate about the shaft 44. The level of rotation is preferably from about 5 to about 15 RPM. The motor means 42 also begins to rotate substrate holder 40 in the plane of the drawing from position A to the position shown in phantom outline and marked B. It should be understood, however, that the substrate holder is moved to position B only for convenience and that the method of the invention can be effected by returning the substrate back to position A after ion milling if this is desired. The speed of rotation is preferably such that the substrate holder moves from position A to position B or back to position A within a time of from about 30 seconds to about 5 minutes. While located at position A, the wafer 36 is not exposed to the ion beam and no ion milling takes place. Ion milling begins as the wafer 36 moves from position A into the path of the ion beam. Optimum ion milling occurs when the shaft 44 is at an angle with reference to the center line of the ion beam of from about 30 to about 60 degrees. It is not necessary that the substrate holder be moved continuously from position A to position B and the substrate holder can be moved in increments and can be stopped at an angle within the range of from about 30 to about 60 degrees for the time required to effect ion milling.

Because of the rotation about shaft 44, all areas within the channels and via holes of wafer 36 are subjected to uniform ion milling. Also because most of the ion milling takes place while the shaft is at an angle of 30 to 60 degrees with respect to the center line, the ions are reflected from the surface of the substrate at an angle which is optimum to project the ions to the catcher anode 46.

EXAMPLE 1

A silicon semiconductor wafer having an etched surface containing channels and via holes as shown in FIG. 1 and having a diameter of 82 cm and a thickness of 0.5 mm was placed in a substrate holder having a thickness of 13 mm in an ion beam apparatus as shown in FIG. 2. As shown in FIG. 3, the distance C between the ion beam source and the junction of the shaft 44 with the center line of the ion beam is 38.89 cm. The shaft length from the junction of the shaft with the center line to the substrate holder is 37.4 mm. At the point where the angle D between the shaft and the center line of the ion beam was 30 degrees, the offset displacement E was 17.2 mm. The substrate was revolved at a speed of 10 RPM.

Table 1 hereinbelow shows that the removal rates for $SiO_2$ and Al/Cu, at an incidence angle of 30 degree, are substantially the same as the removal rate of the silicon glass on the surface of the photoresist. The silicon glass, however, is an integral part of the photoresist stencil to be subsequently lifted off. Therefore, the remaining device surface is cleaned nonselectively.

TABLE 1

Rate of Removal as a Function of Incidence Angle for Various Materials

| | | Removal Rate (A/Min ± 10%) | | | | | | | |
|---|---|---|---|---|---|---|---|---|---|
| Angle (°) | Acc. (V) | Si | $SiO_2$ | Al-Cu | Pt | Spun on Glass | PtSi | Photo-resist AZ-1350 | Sputter Planar Glass |
| 45 | 1000 | 273 | 330 | 342 | 150 | 620 | 20 | 625 | 400 |
| 30 | 1000 | 260 | 256 | 260 | | 450 | | 364 | 300 |
| 15 | 1000 | 185 | 156 | 260 | | ND[a] | | ND | ND |
| 0 | 1000 | ND | 141 | 208 | | ND | | ND | ND |

[a]ND-Not Determined.

Table 1 also illustrates that there is a reduced level of material removal at angles of less than 30 degrees including direct frontal milling at 0°.

Although several preferred embodiments of this invention have been described, it is understood that numerous variations may be made in accordance with the principals of this invention.

What is claimed is:

1. A method for cleaning a substrate having an uneven topographical surface comprising providing an electron beam having a solid angle source of ions with a center line, exposing a planar substrate having an uneven top surface to said solid angle ion beam path, said substrate being located at a predetermined angle with respect to said center line of said ion beam, and continuously revolving said substrate about an axis normal to the plane of said substrate during said exposure.

2. A method in accordance with claim 1 wherein said predetermined location of said substrate being such that a line normal to the surface of said substrate is at an angle of from about 30 to about 60 degrees to said center line of said solid angle source of ions.

3. A method in accordance with claim 1 wherein said substrate is revolved at a speed of from about 5 to about 15 RPM.

4. A method in accordance with claims 1, 2, or 3 wherein said predetermined location is attained by moving said substrate from a first position where the plane of said substrate is parallel to said center line and displaced from said center line to a second position where the plane of said substrate is again parallel and displaced from said center line, said movement being effected in a manner so that said substrate surface is exposed to said ion beam at said predetermined angle with respect to said center line of said ion beam.

5. A method in accordance with claim 4 wherein said movement takes place during a period of from about 30 seconds to about 5 minutes.

* * * * *